US010053881B2

(12) United States Patent
Briggs et al.

(10) Patent No.: US 10,053,881 B2
(45) Date of Patent: Aug. 21, 2018

(54) AUTO-ROTATING AISLE RAIL SYSTEMS AND METHODS

(71) Applicant: HUSSEY SEATING COMPANY, North Berwick, ME (US)

(72) Inventors: Kerry D. Briggs, North Berwick, ME (US); Jonathan Yau, Dover, NH (US)

(73) Assignee: HUSSEY SEATING COMPANY, North Berwick, ME (US)

( * ) Notice: Subject to any disclaimer, the term of this patent is extended or adjusted under 35 U.S.C. 154(b) by 335 days.

(21) Appl. No.: 14/985,668

(22) Filed: Dec. 31, 2015

(65) Prior Publication Data

US 2016/0194880 A1 Jul. 7, 2016

Related U.S. Application Data

(60) Provisional application No. 62/099,340, filed on Jan. 2, 2015.

(51) Int. Cl.
*E04H 3/12* (2006.01)

(52) U.S. Cl.
CPC ..... *E04H 3/123* (2013.01)

(58) Field of Classification Search
CPC .... E04H 3/123; E04F 11/1863; E04F 11/068; E04F 11/1865
See application file for complete search history.

(56) References Cited

U.S. PATENT DOCUMENTS

| | | | | | |
|---|---|---|---|---|---|
| 3,964,215 | A * | 6/1976 | Hartman | E04H 3/123 | 256/65.02 |
| 4,006,564 | A * | 2/1977 | Wiese | E04H 3/123 | 256/65.02 |
| 4,014,522 | A * | 3/1977 | Sutter | E04H 3/123 | 206/518 |
| 5,667,199 | A * | 9/1997 | Hamm | E04F 11/181 | 256/59 |
| 5,813,663 | A * | 9/1998 | Victor | E04H 3/123 | 256/1 |
| 5,820,110 | A * | 10/1998 | Beu | E04H 3/123 | 256/59 |
| 6,328,285 | B1 * | 12/2001 | Wiseman | E04H 3/123 | 256/59 |
| 6,854,216 | B2 * | 2/2005 | Ahrens | E04H 3/123 | 52/183 |
| 9,650,796 | B2 * | 5/2017 | Klingenberg | E04H 3/123 | |
| 2002/0056239 | A1 * | 5/2002 | Paddock | E04H 3/12 | 52/183 |
| 2017/0358842 | A1 * | 12/2017 | Shehan | H01Q 1/241 | |

* cited by examiner

*Primary Examiner* — Jonathan P Masinick
(74) *Attorney, Agent, or Firm* — Preti Flaherty Beliveau & Pachios LLP

(57) ABSTRACT

Improved aisle rail systems and methods for use in conjunction with telescopic or retractable seating systems. A handle portion is at an upper end of a post. A short arm having a roller extends radially from a lower extent of the post. The post is rotationally mounted to a deck of a bleacher system by a support socket. Interaction of the roller with a step mounted on an underlying deck resulting from relative motion of the deck on which the aisle rail system is mounted and the underlying deck results in rotation of the post and associated handle.

24 Claims, 16 Drawing Sheets

AUTO-ROTATING AISLE RAIL SYSTEMS AND METHODS

STATEMENT REGARDING FEDERALLY SPONSORED RESEARCH OR DEVELOPMENT n/a

BACKGROUND OF THE INVENTION

Telescopic or retractable seating systems, commonly referred to as bleachers, provide a degree of flexibility when employed in multi-purpose environments such as gymnasia. During practice periods, there is little need for ample seating as there are typically few spectators. However, during sporting competitions, assemblies, or concerts, accommodation for large groups is necessary. The provision of one discrete chair per person would require excessive manpower and time and storage of such chairs would be complex and space-intensive. Telescopic or retractable bleacher systems can be retracted when seating is not required and extended when an audience is expected.

Preferably, such seating systems are provided with aisle rails to assist individuals in maintaining their balance as they mount or descend the seating system aisles. In fact, certain localities have codified requirements for the provision of aisle rails.

Advances have been made in the mechanisms utilized to reconfigure such bleacher systems, including powered drives for automatic or semi-automatic operation. This further reduces the manpower requirement for reconfiguring the seating systems. However, advances in aisle rail storage and deployment have lagged the advances in seating system manipulation. Thus, the prior art includes aisle rails that must be manually turned or folded from a use position to a stored position, that must be manually removed and stored separately from the seating system, or that must be accommodated in a deployed position when the seating system is retracted, such as by providing a cut-out or other discontinuity in the seating system, by limiting the degree of retraction of the seating system in a closed position, or both. Such prior art systems fail to minimize the manpower required to retract and deploy seating systems with aisle handrails, fail to maximize the usable space in an area in which the seating systems are located due to protruding rails in the closed position, or both.

One approach to addressing these problems is to provide a pivotable handrail in conjunction with a bleacher system. In one embodiment, the handrail comprises an elongated gripping portion at an upper end thereof and a post therebeneath. The post is provided with an outwardly extending cam at a lower end thereof. A cylindrical retaining member surrounds the lower extent of the post and the cam is received in a helical cam slot in the retaining member. The retaining member is affixed to a front or "nose" portion of a deck of the bleacher system. A ramp is disposed on a step below the deck on which the retaining member is mounted. When the bleacher system is extended, the ramp upper surface comes into contact with the post lower extent. As the ramp continues outward with the bleacher system, the post is driven upwards and the cam follows the helical cam slot, thereby rotating the handrail 90 degrees from a closed position, in which the gripping portion is perpendicular to the respective bleacher system aisle, to an open position, in which the gripping portion is aligned with the respective aisle. During bleacher system retraction, the post lower extent moves out of engagement with the ramp and the step upon which it is mounted moves back and under the deck front portion on which the retaining member is mounted. The post thus lowers and, as the cam follows the helical cam slot, rotates 90 degrees from the open position to the closed position.

However, the frictional engagement of multiple aisle rails may increase the force required to reconfigure the bleacher system from either the retracted position to the open position or vice versa. This is particularly true in environments where particulates may be carried onto the bleacher system steps. Such particulates may include sand, dirt, and salt used for de-icing applications.

There thus exists a need for alternative systems and methods for enabling the automatic deployment and retraction of aisle rails in bleacher systems.

BRIEF SUMMARY OF THE INVENTION

The present invention provides improved aisle rail systems and methods for use in conjunction with telescopic or retractable seating systems such as bleachers. The disclosed aisle rail system includes a handle portion at an upper end of a post. When in a deployed or open position, the handle is aligned with the aisle in which it is installed, such that users may grasp the handle portion for support as they gain or descend the extended bleacher steps. When in a stored or open position, the post and handle portion are rotated substantially 90 degrees from the open position, such that the handle is substantially parallel with the front of the closed bleacher system, though in some embodiments, the post and handle are inclined with respect to vertical and lean slightly away from the bleacher system front face when closed.

At the lower end of the post is a short arm that is not co-axial with the post. A proximal end of the arm is affixed to the lower extent of the post such that the short arm extends radially with respect to the post. A roller is rotatably suspended at a distal end of the short arm. The axis of rotation of the roller is parallel to a horizontal plane and orthogonal to the axis of rotation of the post. Thus, the roller rotates in a plane that contains the short arm, that intersects the axis of rotation of the post, and that is co-planar with the plane of the handle portion. When in the stored position, the short arm is substantially parallel with the front of the closed bleacher system.

In one embodiment, the distal end of the short arm forms a yoke, each side of which receives a respective end of an axle upon which the roller is capable of rotation. In another embodiment, the roller is provided as a composite roller having two wheel portions. The distal end of the short arm in this embodiment includes a vertically oriented vane through which is disposed an axle having a wheel portion on each side.

The post is mounted to the bleacher system by a support socket that may take one of several shapes, as will be described in detail below. The support socket receives a lower end of the post with respect to a front face or "nose" of a deck portion of a bleacher system. The proximate end of short arm mates with the post lower end below the support socket. The post is rotatable within the support socket within a limited range of rotation, the range defined by one or more of various mechanical devices, to be described subsequently. Internal bearings within the support socket facilitate this rotation.

In some embodiments, the post is configured to travel vertically within the support socket in conjunction with rotation. In these embodiments, the angle between the short arm and the vertical post is fixed. In these embodiments, the post, handle portion, and short arm are rotated to the closed position through the urging of a resilient member such as a torsion spring. In the closed position, the roller at the distal end of the short arm is not in contact with any other surface and the post is free to rotate under the urging of the resilient member.

As the bleacher system is extended outwardly, the roller of the short arm comes into initial contact with a step disposed upon an underlying deck portion. This contact urges the roller, short arm, and thus the post with handle portion to rotate until the short arm is substantially aligned with the bleacher system aisle. Once so aligned, further extraction of the bleacher system results in the roller traveling across the step until it reaches a ramp disposed upon the step upper surface. As the roller travels up the ramp in response to the extraction of the lower step beneath the aisle rail system, the post moves up into a locked position within the support socket through one of several mechanical arrangements. This keeps the handle portion is the appropriate rotational configuration for use by those traveling up or down the aisle steps.

In another embodiment, the support socket comprises a helical groove and the post comprises a protruding cam configured to fit and travel within the helical groove. As the roller mechanically interferes with the step upon bleaching system extraction, rotation of the post results in elevation of the post. Complete rotation and elevation occur through a similar interaction with the roller and a ramp disposed upon an upper surface of a step therebeneath. The cam may be one end of a through-pin, in which there are two such cams, and the support socket would be provided with two complimentary helical grooves.

In another embodiment, the post does not move vertically within the support socket in conjunction with rotation. In this embodiment, the angle between the short arm and the vertical post is variable. As the bleacher system is extracted from the closed position, the short arm roller interferes mechanically with the step on the lower deck, resulting in rotation of the post within the support socket. Rather than the entire post raising as the roller travels up the ramp disposed on an upper surface of a step therebeneath, the short arm pivots upwards about a pivot point where the proximal end of the short arm meets the lower end of the post. When the aisle rail system is in the open position, the short arm is configured to be received within a feature formed in the support socket to prevent unintended rotation of the post and handle portion.

In all embodiments, closing the bleacher systems results in the roller traveling down the respective ramp, across the lower step upper surface and out of contact with the lower step completely. In the embodiment with a helical groove, the cam travels in a path that results in rotation of the post into the closed position. In the other embodiments, a resilient member such as a torsion spring disposed between the support socket and the post urges the post into the closed position.

DETAILED DESCRIPTION OF THE INVENTION

Figure 1A:
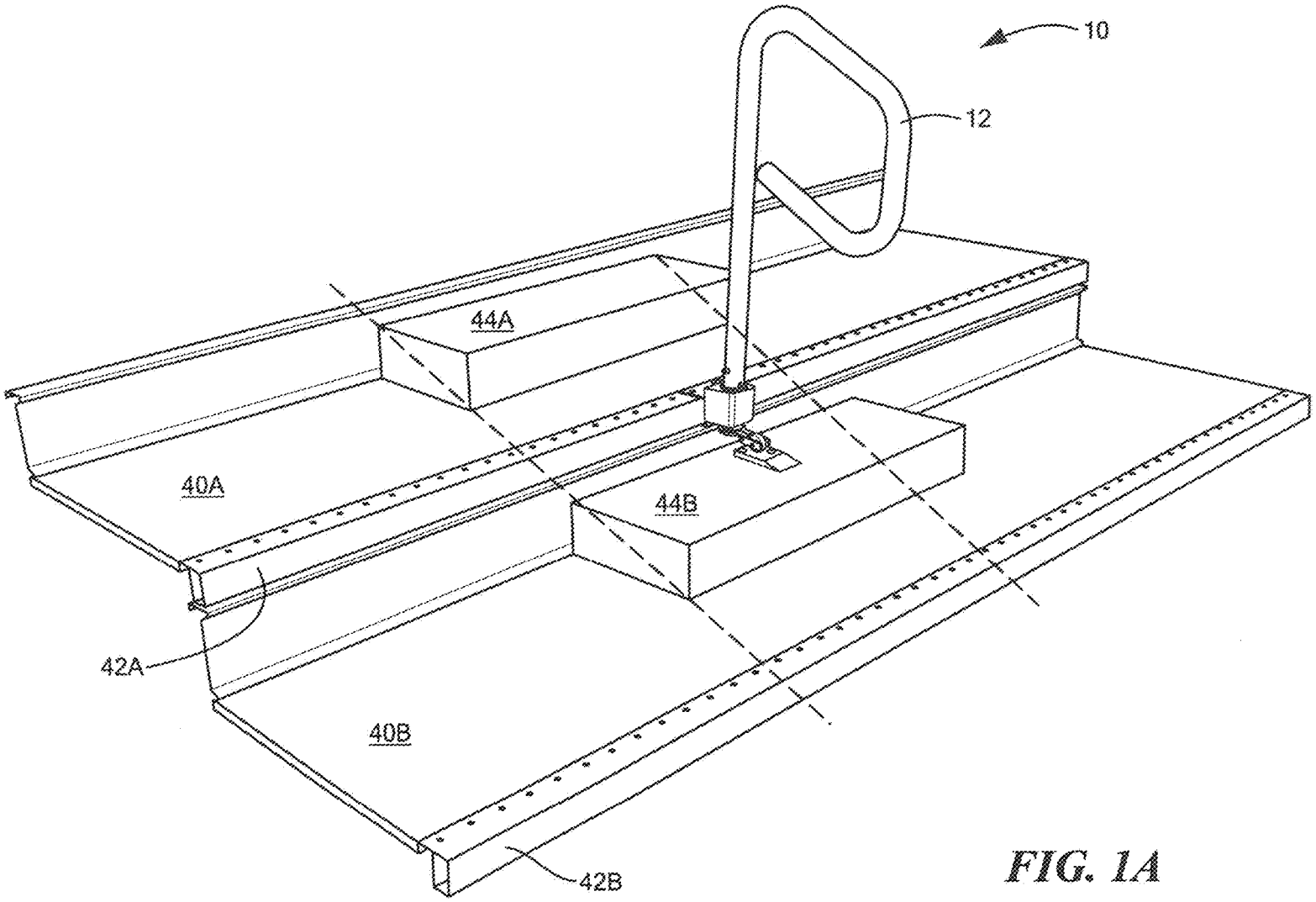
FIG. 1A is a perspective view of a first embodiment of an auto-rotating aisle rail system according to the present invention in a first, open position.

With reference to FIG. 1A, a first embodiment of an auto-rotating aisle rail system 10 is depicted in perspective. The aisle rail system is intended for installation in conjunction with a telescopic or retractable seating system such a bleacher system. FIGS. 1A through 4D depict portions of an exemplary bleacher system environment in which the presently disclosed invention can be disposed. The bleacher systems themselves may be those found in the prior art, and include multiple decks 40A, 40B. Each deck has a respective front end or nose surface 42A, 42B. When the bleacher system is in an extended or open position, consecutive decks form a series of stepped platforms. A variety of seating features (not shown) may be provided, as known to one skilled in the art. Each deck has at least one respective step 44A, 44B, with consecutive decks having steps that are linearly aligned, such that the deck surfaces and the steps form a linear stairway. Such a stairway is also referred to as an aisle, in that various seating surfaces are typically arrayed along the deck front edges on one or both sides of the steps and each aisle enables users to mount or descend the decks and steps to reach or to leave seating in the bleacher system. Aisles are depicted in FIGS. 1A, 2A, 3A, and 4A in dashed lines.

When the bleacher system is in a retracted or closed position, the decks 40A, 40B are substantially vertically aligned, as shown in FIGS. 1C, 2C, 3C, and 4C. In this position, the deck noses 42A, 42B are substantially vertically aligned.

Translation between the closed position and the open position and between the open position and the closed position can be achieved either manually, by one or more users manually pushing or pulling on a portion of the bleacher system, or automatically, such as by actuation of a controller in communication with a motive means such as a drive motor, both as known in the art. The mechanisms employed for imparting relative motion of the plural decks are also known in the art. The decks and features shown in FIGS. 1A through 4D are exemplary and may be replaced by other specific bleacher systems having similar features.

The four auto-rotating aisle rail system embodiments of FIGS. 1A through 4D are depicted in similar positions, though various features are unique to each embodiment. In FIGS. 1A, 1B, 2A, 2B, 3A, 3B, 4A, and 4B, the bleacher systems are shown in the open position and the respective aisle rail systems are shown in the open and locked position. As discussed in greater detail below, each aisle rail system comprises a respective handle 12, 112, 212, 312 useful to users in maintaining their balance as the aisle stairway is mounted or descended. The handles are substantially linearly aligned with the aisles when in the open position. The handles as depicted are rhomboid in shape, however a variety of shapes can be employed. Preferably, regardless of their shape, the handles are substantially planar. In cross-section, the handles can be circular (as shown in FIG. 1A), square (as shown in FIGS. 2A, 3A, and 4A), oval, rectangular, or other shape. It is understood that the choice of handle shape and cross-section for each embodiment disclosed herein is a matter of design choice. For example, the handle of the embodiment in FIGS. 1A through 1D could be square without altering the functionality of that aisle rail system.

In FIGS. 1C, 1D, 2C, 2D, 3C, 3D, 4C, and 4D, the bleacher systems are shown in the closed position and the respective aisle rail systems are shown in the closed and stored position. In this position, the handles 12, 112, 212, 312 are substantially parallel to the plane formed by the vertically overlapped deck noses 42A, 42B. To facilitate storage, the handles may extend slightly outward, away from the plane formed by the vertically overlapping deck noses.

FIGS. 1A through 1D depict a first embodiment of an auto-rotating aisle rail system 10 according to the present invention. The system comprises a handle portion 12, as previously discussed, and a post 14. In this embodiment, the handle and post are integrally formed. In embodiments to be discussed subsequently, the handle and post are two discrete elements that are mechanically joined.

Figure 1B:
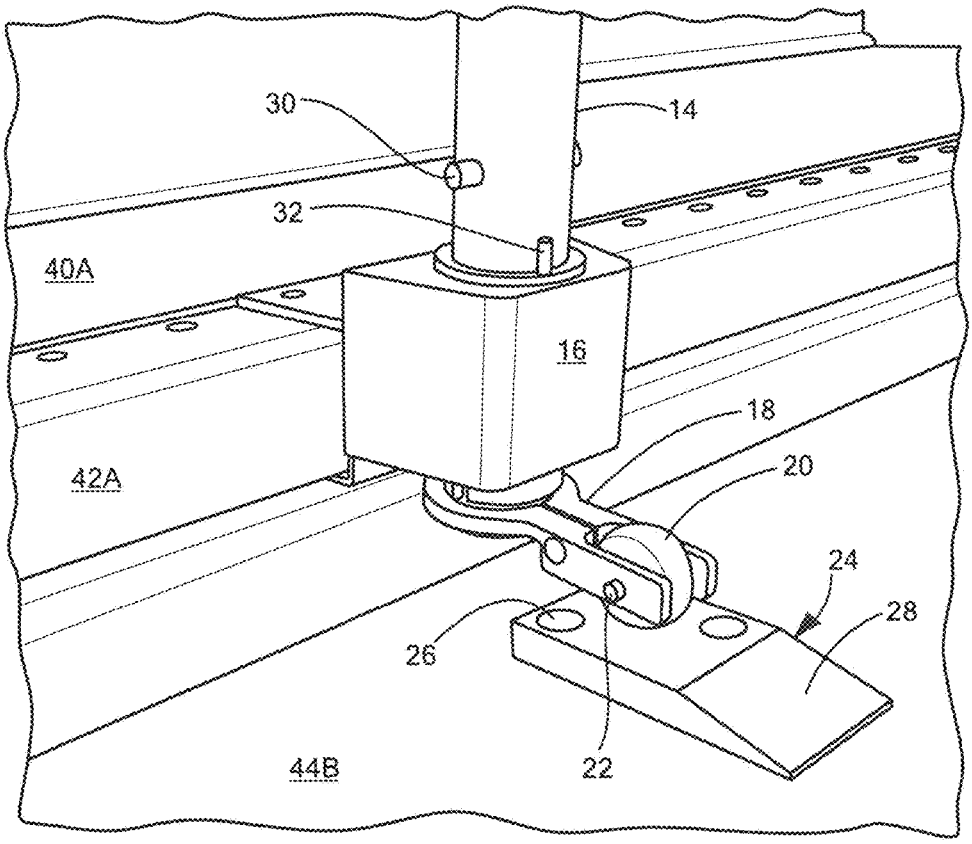
FIG. 1B is a detailed view of a portion of the auto-rotating aisle rail system first embodiment of FIG. 1A.

The post is mounted to a respective deck nose 42A via a support socket 16. The support socket can have one of various shapes. While certain features of the support socket are dependent upon the respective embodiment, other factors, such as exterior shape, may be chosen for reasons such as cost, strength, aesthetics, etc. In FIG. 1B, the support socket is a formed and/or welded rectilinear box. Bearings (not shown) are preferably provided at upper and lower extents of the support socket to enable the post to freely rotate therein, subject to mechanical constraints.

At a lower extent of the post 14 is a short arm 18 extending radially away from the post. A proximal end of the short arm is attached to the lower end of the post through any conventional means such that the short arm is adapted to rotate with the post. At a distal end of the short arm, a roller 20 is disposed on a respective axle 22. The distal end of the short arm is split into a yoke, with the axle suspended on opposing sides of the yoke, such that the roller is adapted for rotation within the yoke, in a plane that contains the post.

Figure 1C:
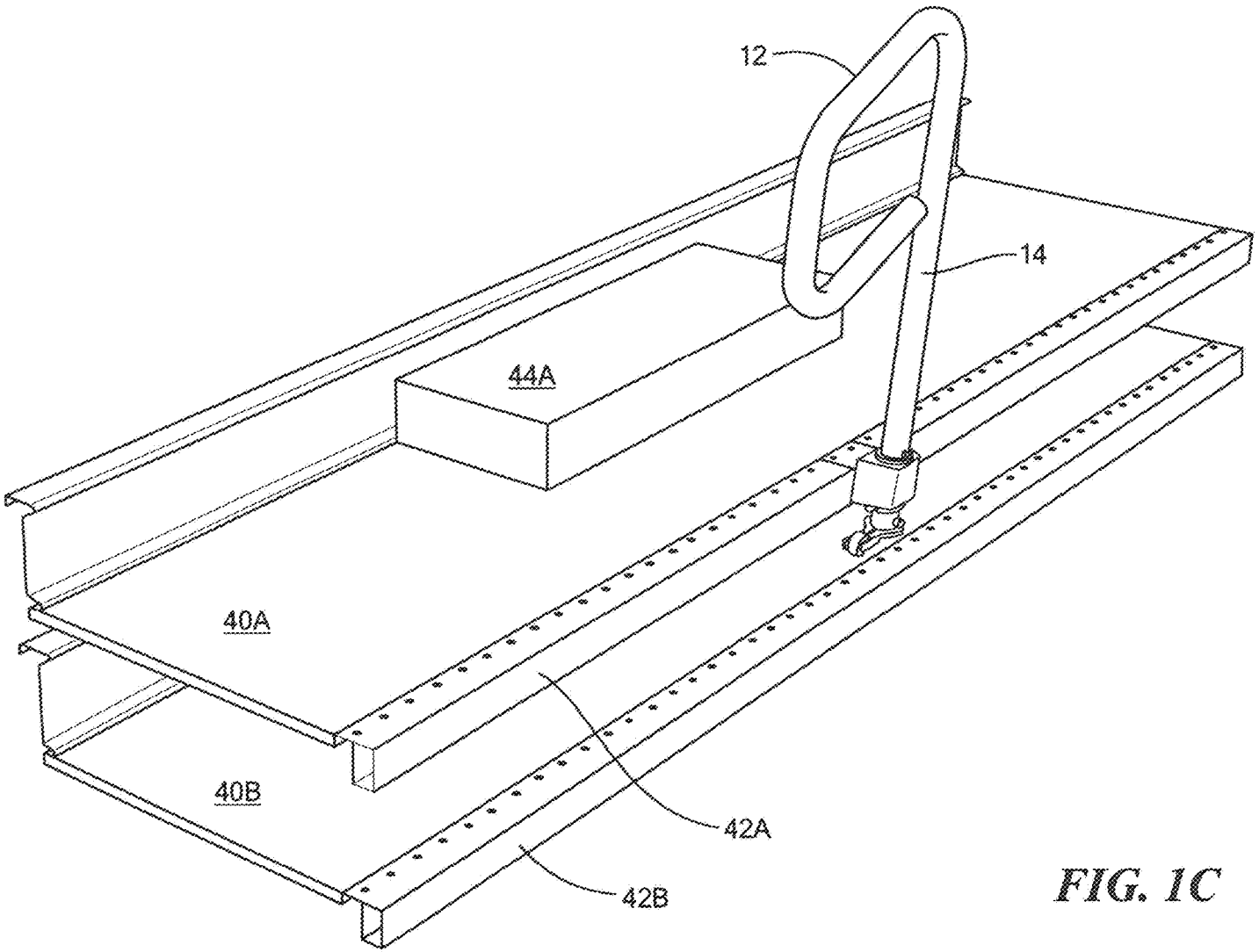
FIG. 1C is a perspective view of the auto-rotating aisle rail system first embodiment of FIG. 1A in a second, closed position.
Figure 1D:
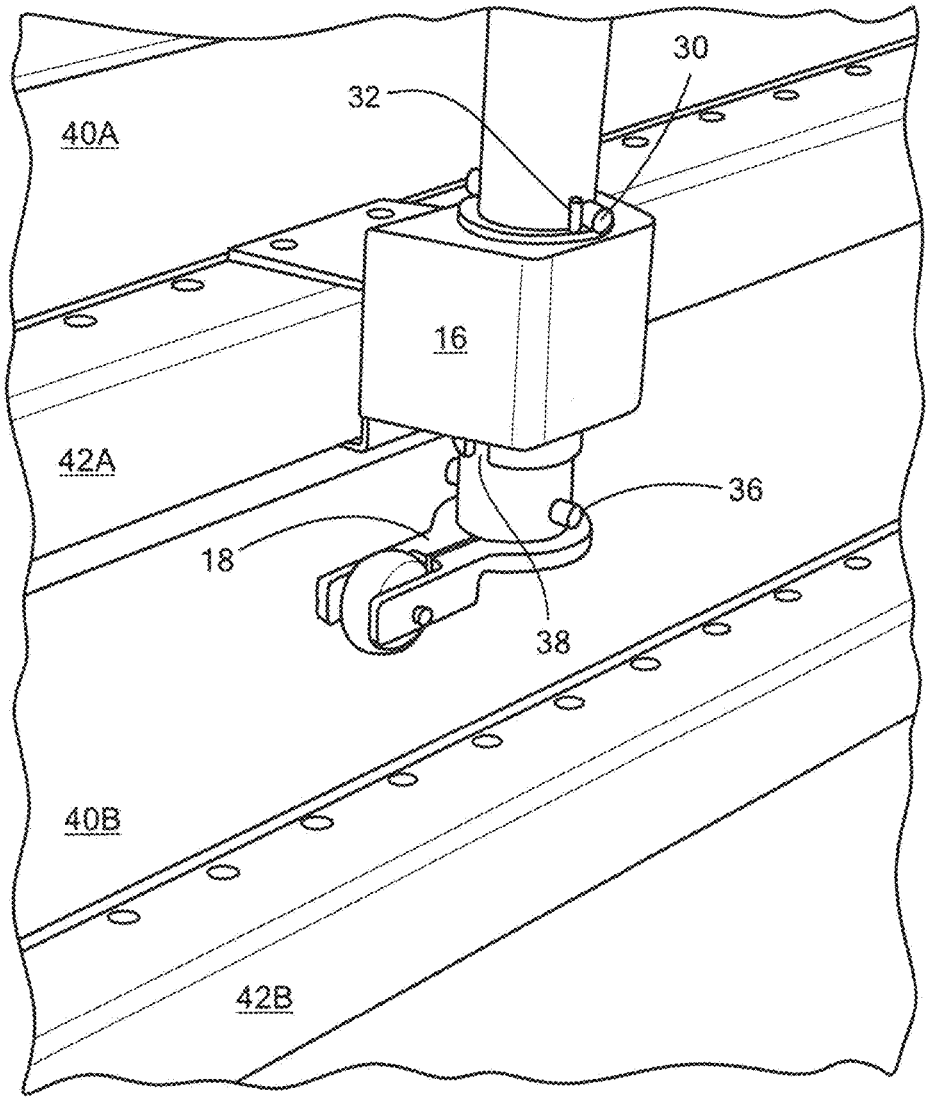
FIG. 1D is a detailed view of a portion of the auto-rotating aisle rail system first embodiment of FIG. 1C.
Figure 2A:
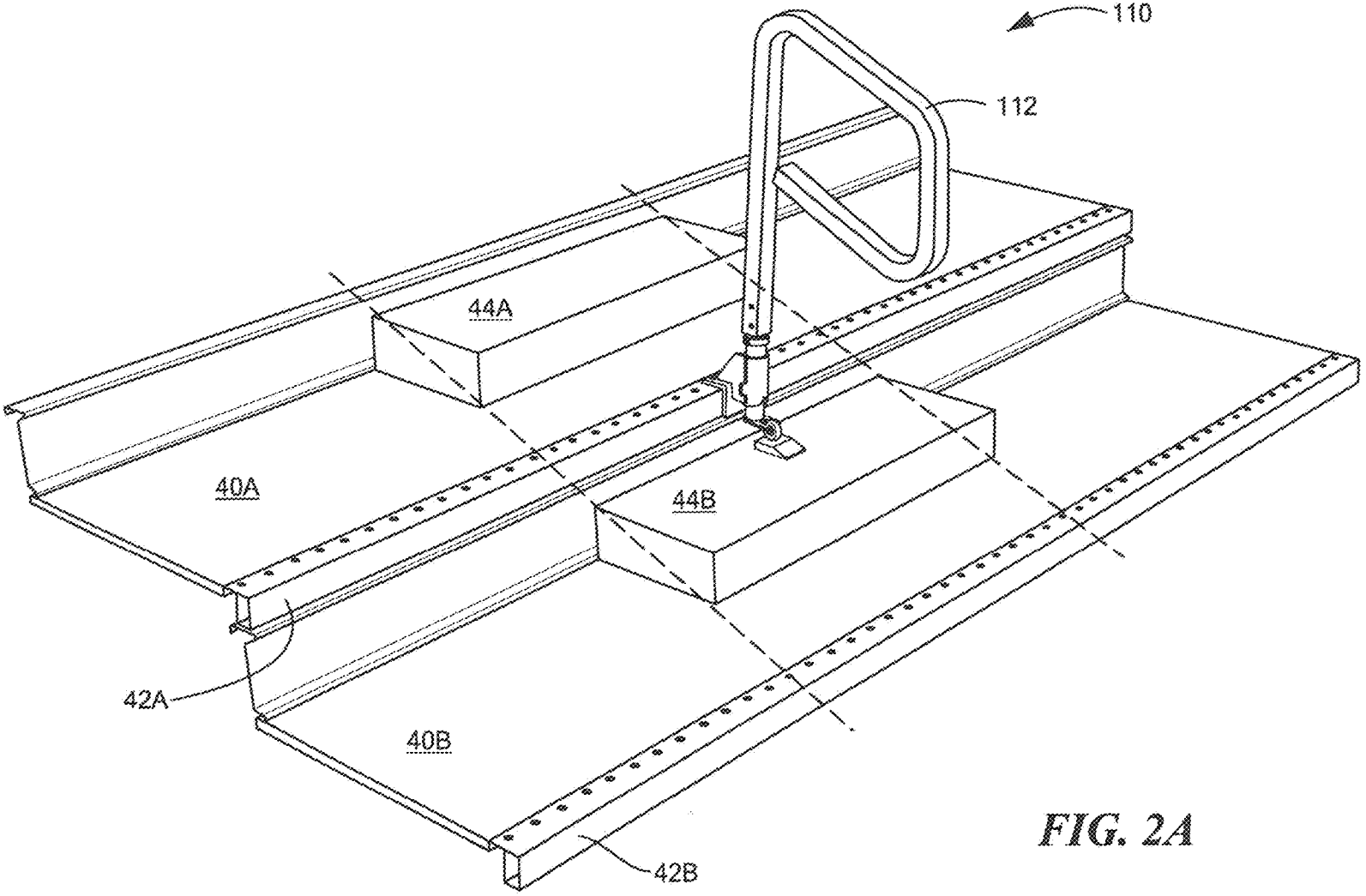
FIG. 2A is a perspective view of a second embodiment of an auto-rotating aisle rail system according to the present invention in a first, open position.
Figure 2B:
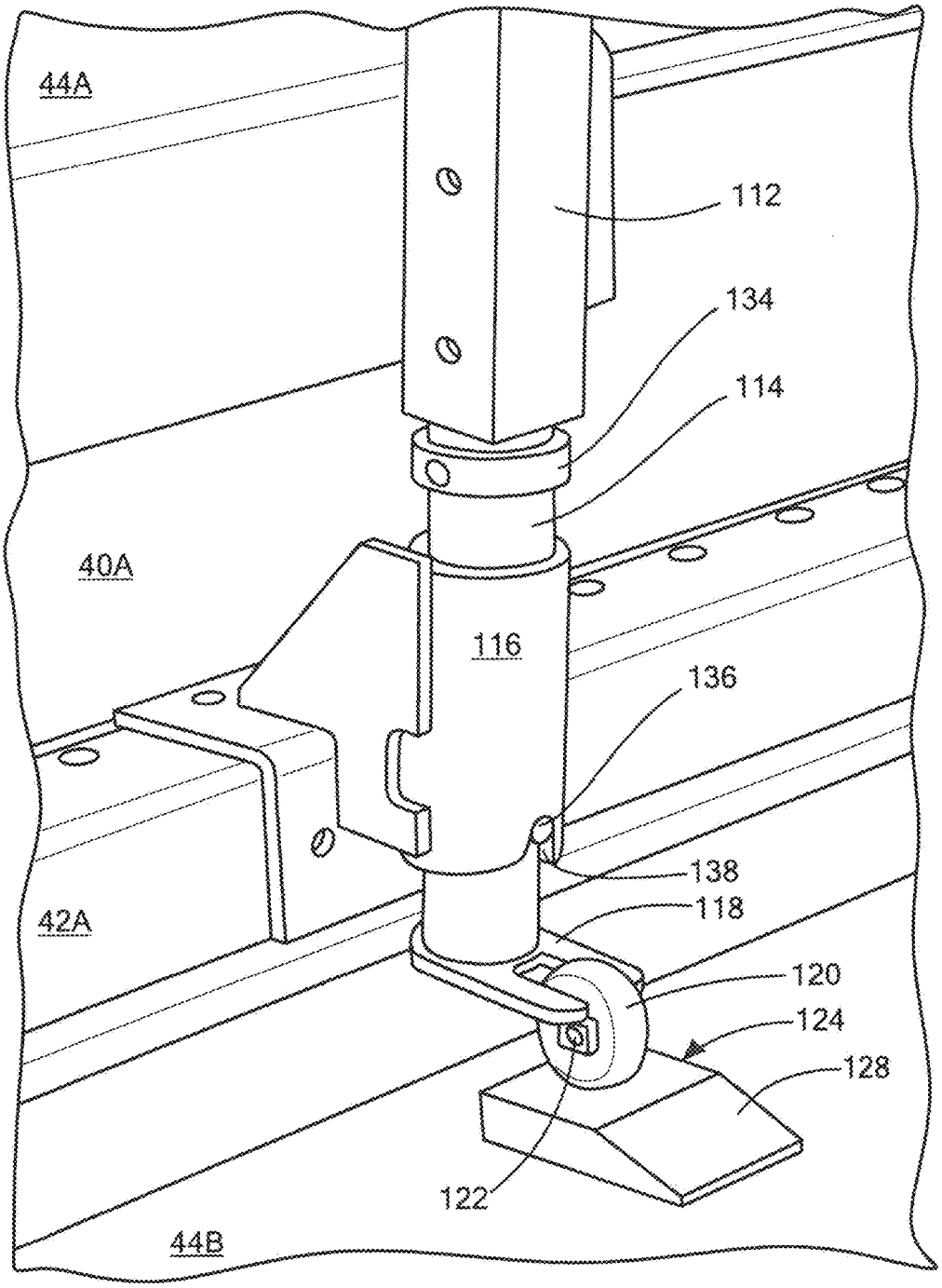
FIG. 2B is a detailed view of a portion of the auto-rotating aisle rail system second embodiment of FIG. 2A.
Figure 2C:
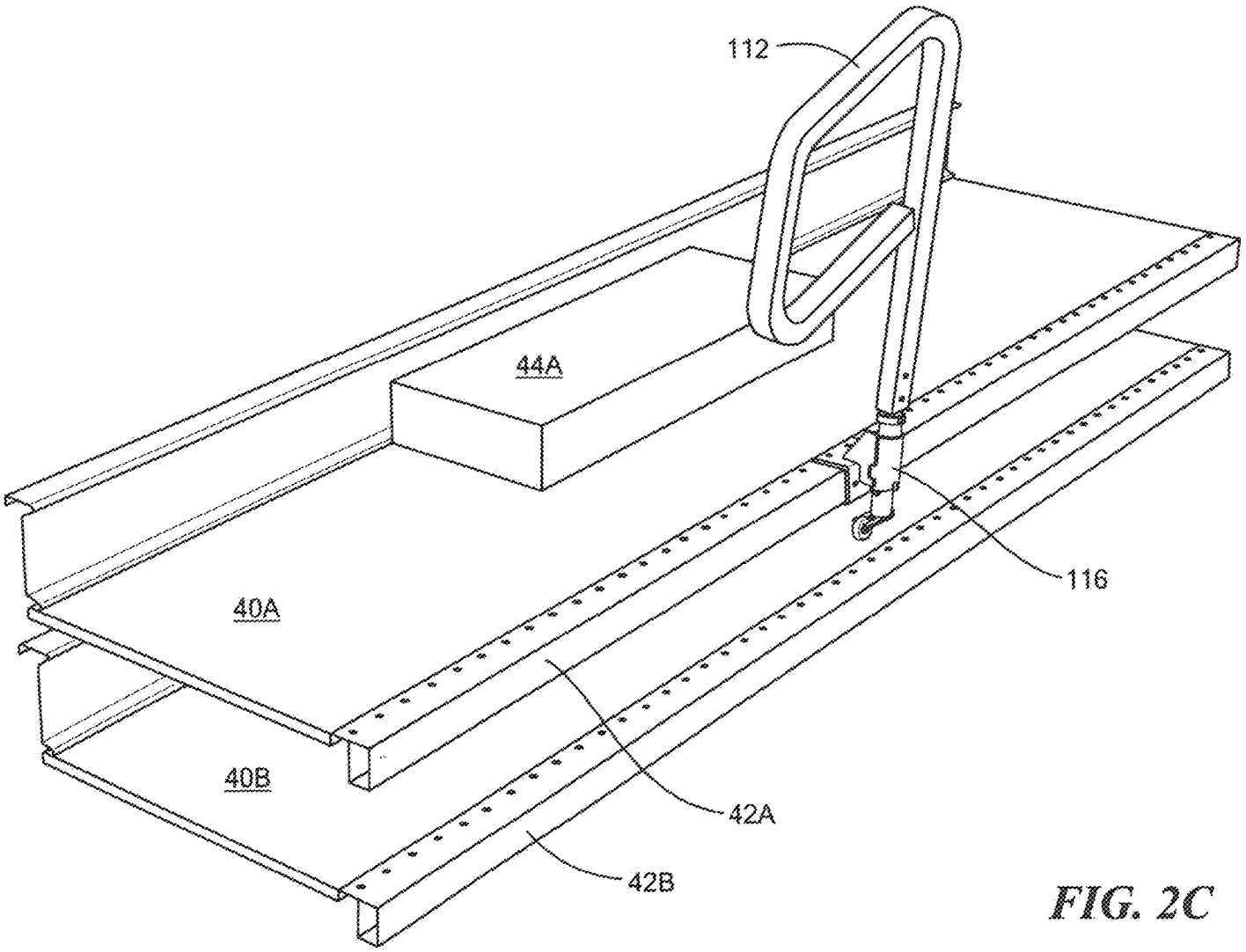
FIG. 2C is a perspective view of the auto-rotating aisle rail system second embodiment of FIG. 2A in a second, closed position.
Figure 2D:
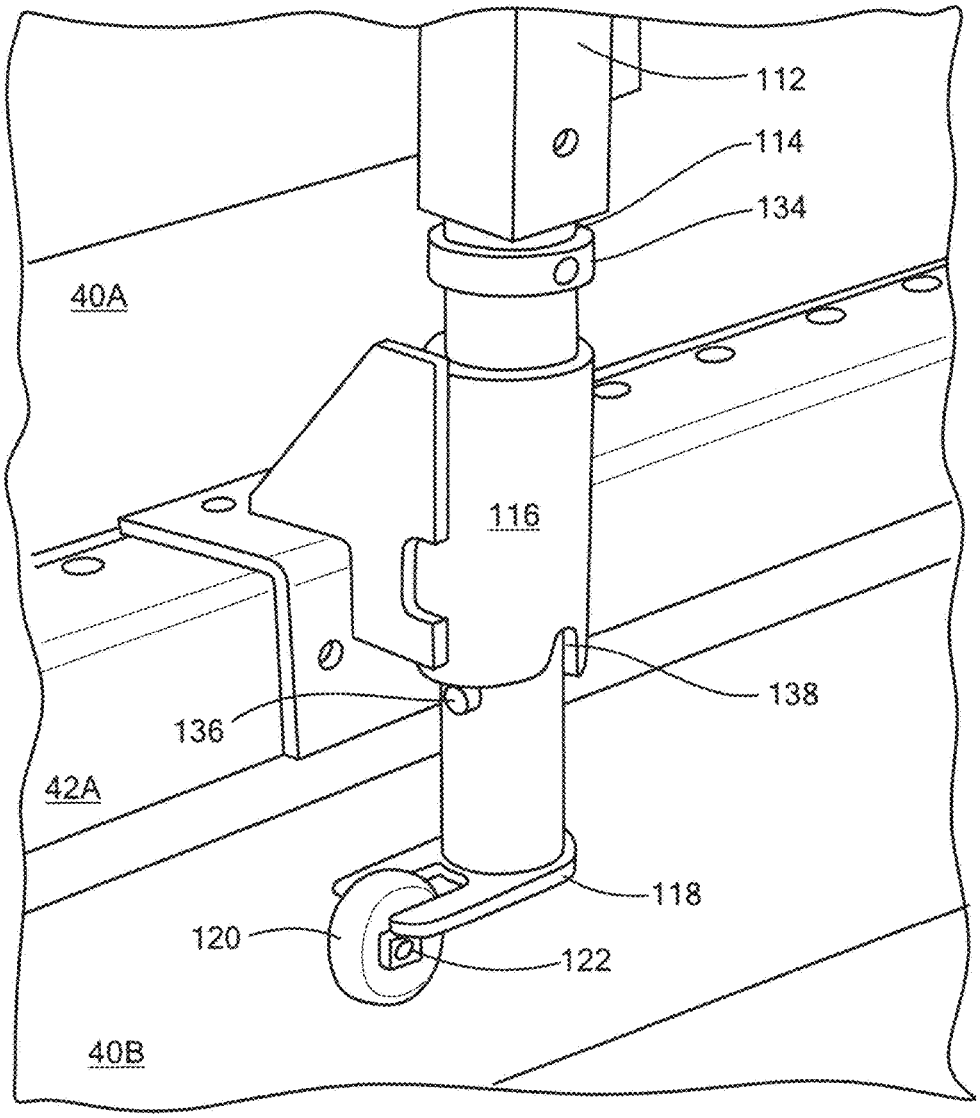
FIG. 2D is a detailed view of a portion of the auto-rotating aisle rail system second embodiment of FIG. 2C.

In FIG. 1B, an upper through-pin 30 extends through and across the post 14, with each end of the through-pin extending slightly beyond the outer surface of the post. In FIG. 1D, a lower through-pin 36 similarly extends through a lower end of the post. In FIG. 1B, a mechanical stop 32 extends vertically from the support socket 16. There may be one mechanical stop, as depicted, or a complimentary mechanical stop 180 degrees about the upper edge of the support socket. In FIG. 1D, slot 38 is formed in a lower extent of the support socket. Preferably, there are two such slots, disposed 180 degrees apart around the lower extent of the support socket.

In FIGS. 1A and 1B, the bleacher system is open and the aisle rail system 10 is also open and locked. Locking is achieved by the lower through-pin 36 having been rotated into alignment with the two slots 38 in the lower extent of the support socket 16 and raised into the slots, thereby preventing rotation of the post 14 and associated handle 12. As the bleacher system is moved towards the closed position, there is relative movement between the deck nose 42A, upon which the respective support socket 16 is mounted, and the underlying step 44B as the step moves under the deck 40A. The roller 20 rotatably mounted on the distal end of the short arm 18 rolls across an upper surface of a ramp 24 disposed on the upper surface of the step 44B. The ramp is disposed on the step via mechanical fasteners 26 such as screws, rivets or other known elements. Preferably, an upper extent of the fasteners is flush or recessed with respect to the ramp upper surface.

As the bleacher system is further closed and the step 44B on the lower deck 40B proceeds under the upper deck 40A upon which is mounted the aisle rail system, the roller 20 proceeds down an inclined surface 28 of the ramp. As the short arm is affixed to the lower end of the post 14, this results in the post itself moving vertically downward. As a result, the lower through-pin 36 comes out of engagement with the two slots 38, thereby freeing the post for rotation about its vertical axis of rotation. An interior return spring (not shown), disposed within the support socket 16 and connected between the support socket and the post, biases the post in a rotational direction towards the closed position shown in FIGS. 3C and 3D.

Further movement of the bleacher system results in the roller proceeding across the top of the lower step 44B then off the edge of the step. This results in the post 14 moving vertically downward until the upper through-pin 30 comes into contact with an upper edge of the support socket 16. The upper through-pin thus limits the downward motion of the aisle rail system 10. The return spring biases the aisle rail system about the rotational axis of the post until the short arm 18 is orthogonal to the linear direction of the aisle and parallel to the desk nose 42A. Interference between the upper through-pin 30 and the mechanical stops 32 prevent the post from over-rotating beyond the closed position. When the bleacher system reaches the closed position, the aisle rail system is closed, as shown in FIGS. 1C and 1D.

When the bleacher system is opened, the lower step 44B eventually comes into contact with the side edge of the short arm roller 20, thus urging the post 14 and handle 12 to rotate about a vertical axis against the urging of the return spring internal to the support socket 16. As the roller is drawn up, on top of the lower step, the post 14 also moves up. Eventually, the roller is drawn across the inclined portion 28 of the ramp 24. This again raises the post and brings the lower through-pin into engagement with the two slots 38 in the lower extent of the support socket 16, thereby locking the aisle rail system into the open position.

While the upper and lower through-pins 30, 36 are shown as being mutually parallel, this is not a requirement. In one of many alternative embodiments, they may be mutually orthogonal in vertical projection. The respective grooves 38 and/or mechanical stop 32 would be positioned accordingly to function as described above.

A second embodiment of the aisle rail system 110 is depicted in FIGS. 2A through 2D. As noted, a handle portion 112 is provided of square cross-section and rhomboid shape, though these are matters of design choice. The handle portion, preferably formed of metal, is mechanically connected to a post 114, also of metal and of circular cross-section, such as through welding or via mechanical fasteners including screws or bolts, washers and nuts, etc., as known in the art. The post is disposed within a support socket 116 mounted to the nose portion 42A of a respective deck 40A. In this embodiment, the support socket is a round tube with welded side supports connected through known techniques to the deck nose 42A. Internal bearings (not shown) within the support socket allow the post to rotate about a vertical axis within the support socket. A torsion spring (not shown) mounted within the post and vertical extent of the handle portion and to the support socket biases the aisle rail system 110 towards a closed position.

Above the support socket 116, the post 114 is fitted with an upper locking collar 134, and below the support socket, the post is fitted with a lower through-pin 136. The lower extent of the support socket is provided with two slots 138 (only the forward of which is shown) disposed 180 degrees about the vertical axis of rotation of the post.

At a lower extent of the post 114 is mated a proximal end of a short arm 118, whereby the short arm and the post are mutually rotatable about the vertical axis of rotation. The distal end of the short arm is divided into two arms between which is suspended an axle 122 upon which a roller 120 is mounted for rotation.

Figure 3A:
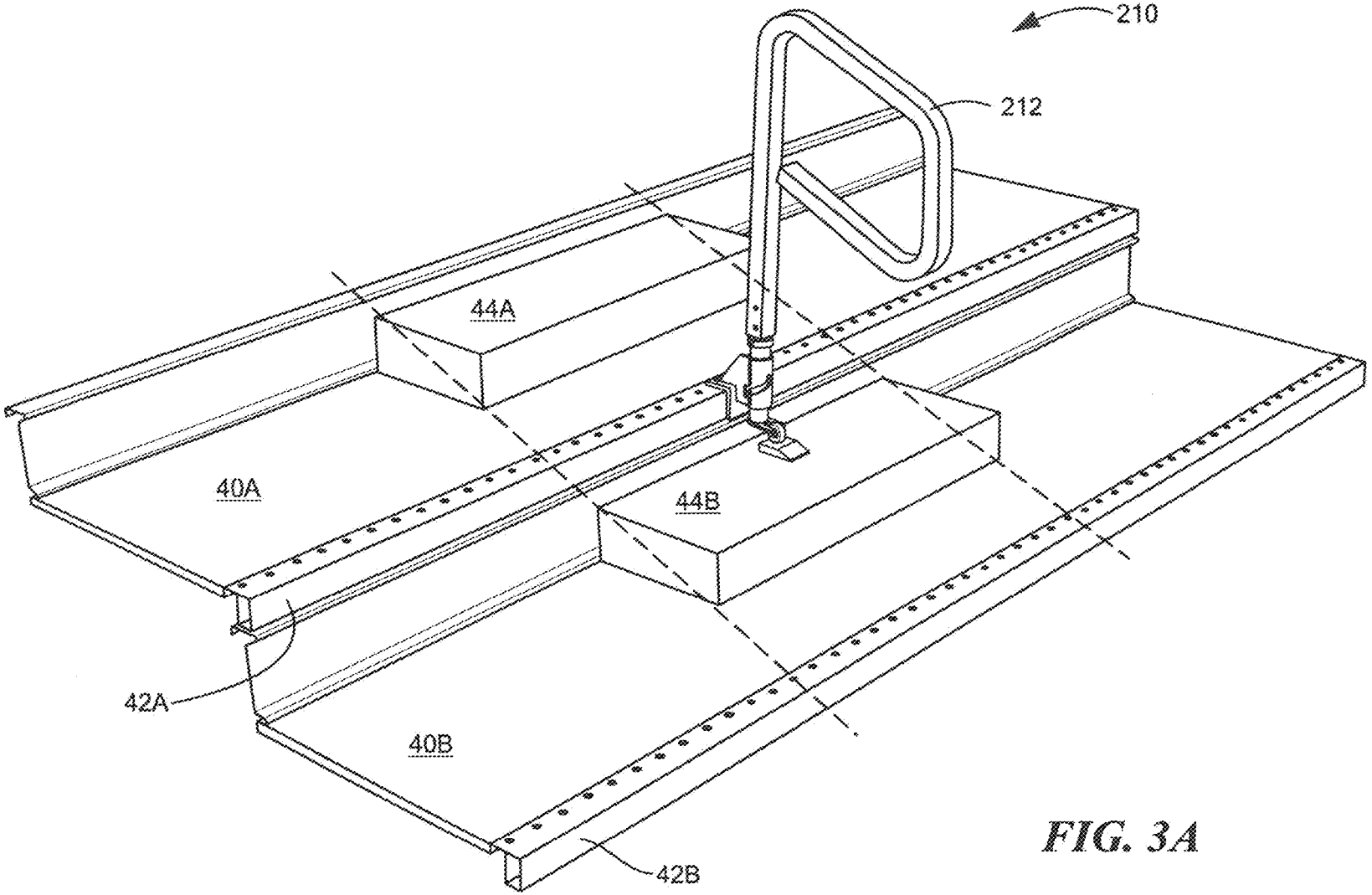
FIG. 3A is a perspective view of a third embodiment of an auto-rotating aisle rail system according to the present invention in a first, open position.
Figure 3B:
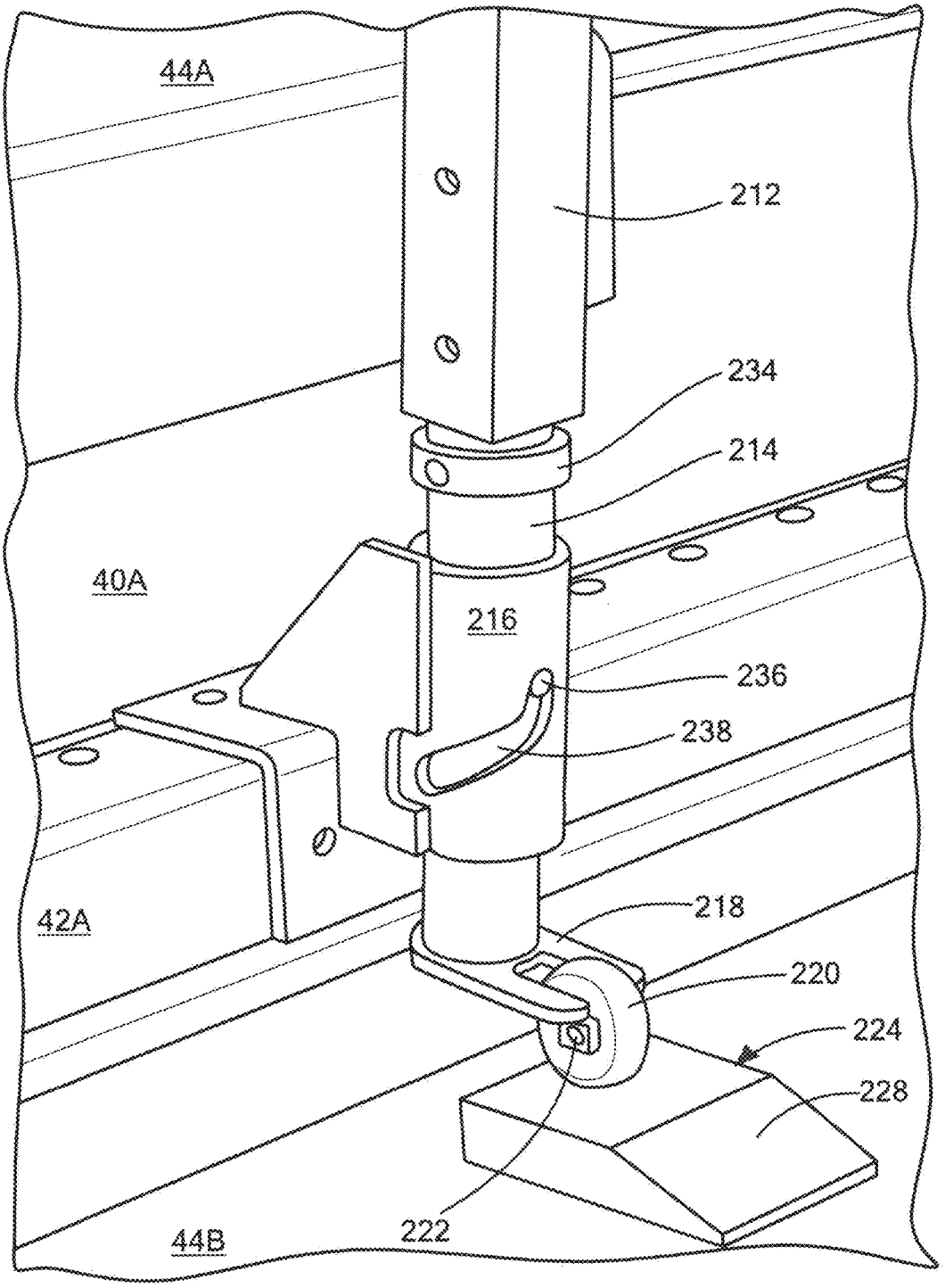
FIG. 3B is a detailed view of a portion of the auto-rotating aisle rail system third embodiment of FIG. 3A.
Figure 3C:
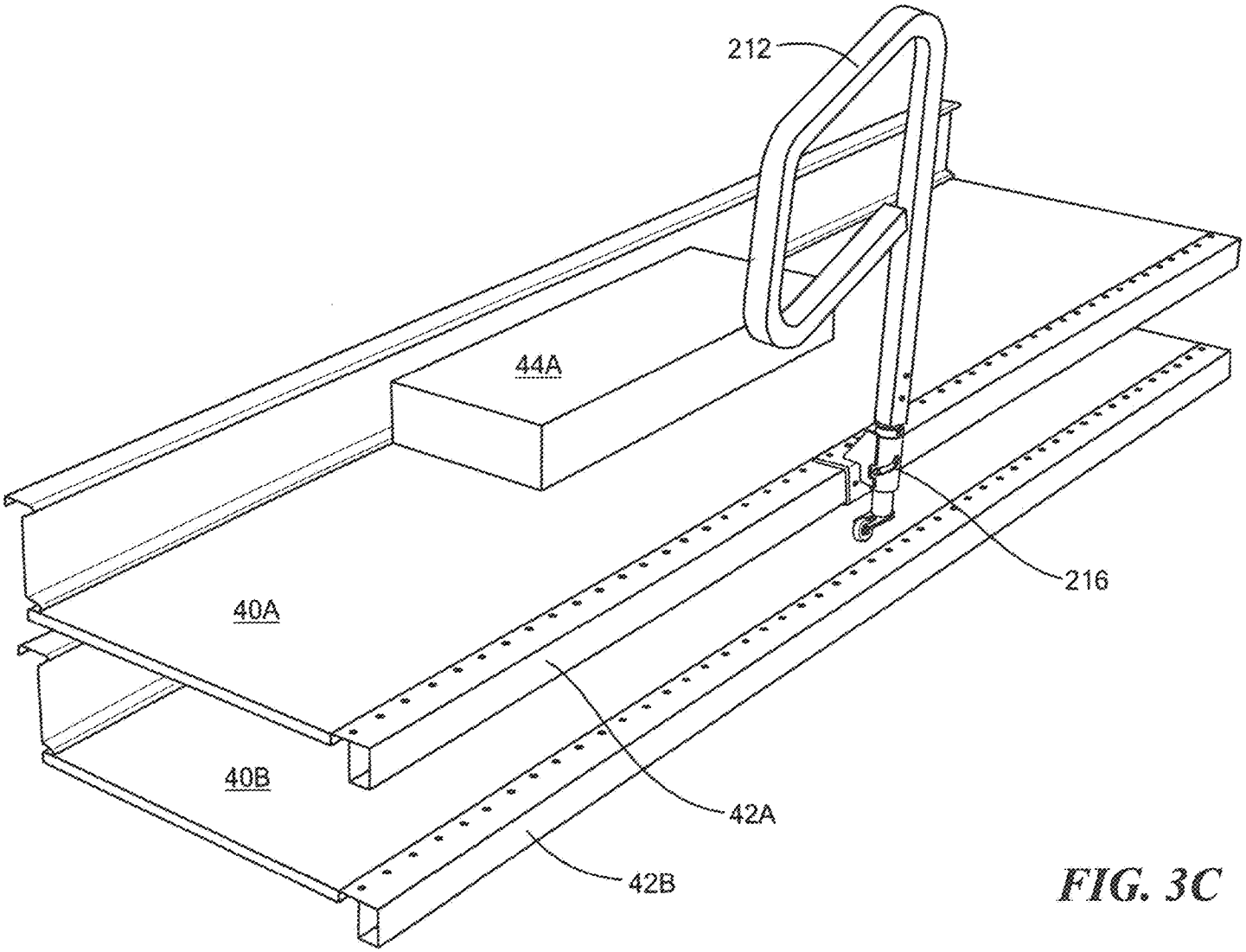
FIG. 3C is a perspective view of the auto-rotating aisle rail system third embodiment of FIG. 3A in a second, closed position.
Figure 3D:
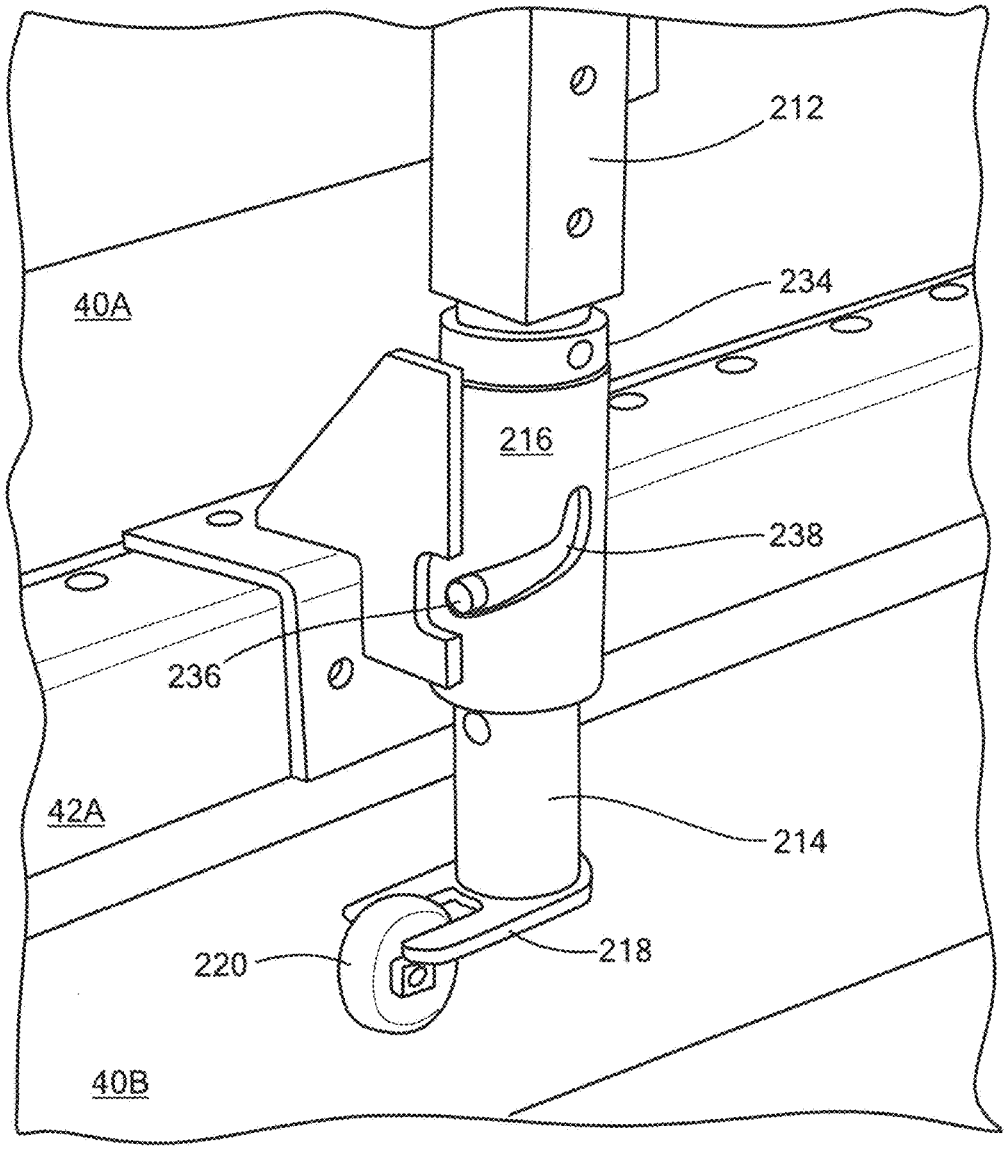
FIG. 3D is a detailed view of a portion of the auto-rotating aisle rail system third embodiment of FIG. 3C.

In a fashion similar to that of the first embodiment, in an open position, the roller 120 is disposed on top of a ramp portion 124 mounted to the top of an underlying step 44B. In this position, the lower through-pin 136 is received within the two slots 138, thereby rotationally locking the aisle rail assembly in the open position. As the bleacher system begins moving towards a closed position, the roller begins rolling across the ramp and down an inclined portion 128 thereof, whereby the post 114 moves downward. The lower through-pin thus comes out of engagement with the two slots, rotationally freeing the post. With further relative movement of the deck 40A and lower step 44B, the roller proceeds across the step upper surface, then off that surface. The roller, short arm and post all move downward until the upper locking collar 134 comes into contact with the upper extent of the support socket 116. The internal torque spring biases the aisle rail system 110 into the closed position, as shown in FIGS. 3C and 3D. Optionally, the lower extent of the support socket 116 may be provided with mechanical features such as downwardly extending tabs, similar to the mechanical stop 32 in FIG. 1B, that prevents the lower through-pin 136 from over-rotating past the closed position.

When the bleacher system is opened, the lower step 44B eventually comes into contact with the side edge of the short arm roller 120, thus urging the post 114 and handle 112 to rotate about a vertical axis against the urging of the torsion spring internal to the post. As the roller is drawn up, on top of the lower step, the post 114 also moves up. Eventually, the roller is drawn across the inclined portion 128 of the ramp 124. This again raises the post and brings the lower through-pin 136 into engagement with the two slots 138 in the lower extent of the support socket 116, thereby rotationally locking the aisle rail system 110 into the open position.

FIGS. 3A through 3D depict a third embodiment 210 of the aisle rail system according to the present invention. The aisle rail system comprises a handle portion 212 provided of square cross-section and rhomboid shape, though these are matters of design choice. The handle portion, preferably formed of metal, is mechanically connected to a post 214, also of metal and of circular cross-section, such as through welding or via mechanical fasteners including screws or bolts, washers and nuts, etc., as known in the art. The post is disposed within a support socket 216 mounted to the nose portion 42A of a respective deck 40A. The illustrated support socket is a round tube with welded side supports. The support socket is preferably provided with upper and lower internal bearings (not shown) to facilitate easy rotation of the aisle rail system. Above the support socket, the post is fitted with a locking collar 234. At a lower extent of the post, a proximal end of a short arm 218 is affixed, such that the short arm and the post are mutually rotatable about a vertical axis of post rotation. Similar to the short arm 118 of FIGS. 2A through 2D, a distal end of the short arm of this third embodiment is divided into two arms between which is suspended an axle 222 upon which a roller 220 is mounted for rotation.

Unlike the previous embodiments, the support socket 216 of this embodiment is provided with a helical slot 238 formed in the round tube through which extends a cam 236 protruding from the outer surface of the post. In an open position, as shown in FIGS. 3A and 3B, the cam is retained at an upper end of the helical slot and thus prevents the post 214 and handle portion 212 from rotating.

In a fashion similar to that of the first and second embodiments, in an open position, the roller 220 is disposed on top of a ramp 224 mounted to the top of an underlying step 44B. In this position, the cam 236 is at the upper end of the helical slot 238, thereby rotationally locking the aisle rail assembly in the open position. As the bleacher system begins moving towards a closed position, the roller begins rolling across the ramp and down an inclined portion 228 thereof, whereby the post 214 moves downward. The cam thus follows the helical slot, thereby rotating the post towards the closed position. With further relative movement of the deck 40A and lower step 44B, the roller proceeds across the step upper surface, then off that surface. The roller, short arm and post all move downward until the upper locking collar 234 comes into contact with the upper extent of the support socket 216 and/or the cam comes into contact with the lower extent of the helical slot. An optional torque spring (not shown) may be disposed in the support socket and between the support socket and the post in order to bias the aisle rail assembly towards the closed position.

The illustrated helical slot has a general constant rate of change about the support socket along the vertical length. However, the slot can also be provided with a substantially vertical portion at the uppermost extent, such that the post moves substantially vertical, without a rotational component, when the roller 220 traverses the ramp 224 and underlying step 44B. Only when the roller becomes disengaged from the step as a result of relative movement between the step 44B and the dock 40A upon which the aisle rail system 210 is mounted is a radial component of the groove introduced, thereby causing rotation of the post 214 with further downward movement.

When the bleacher system is opened from the closed position, the lower step 44B eventually comes into contact with the side edge of the short arm roller 220, thus urging the post 214 and handle 212 to rotate about a vertical axis. Such urging would be against the urging of the optional torque spring, if employed. As the roller is drawn up, on top of the lower step, the post 214 also moves up and the cam 236 follows the helical groove 238, thus rotating the post about its vertical axis. Eventually, the roller is drawn across the inclined portion 228 of the ramp 224. This again raises the post and brings the cam to the upper extent of the helical groove, whereby the aisle rail assembly 210 is in the open position.

In a variation on this third embodiment, the cam 236 is one end of a through-pin and the helical groove is duplicated on the opposite side of the support socket 216, whereby the protruding ends of the through-pin extend into the complimentary helical grooves.

A fourth embodiment of the aisle rail system 310 is depicted in FIGS. 4A through 4D. As noted, a handle portion 312 is provided of square cross-section and rhomboid shape, though these are matters of design choice. The handle portion, preferably formed of metal, is mechanically connected to a post 314, also of metal and of circular cross-section, such as through welding or via mechanical fasteners including screws or bolts, washers and nuts, etc., as known in the art. The post is disposed within a support socket 316 mounted to the nose portion 42A of a respective deck 40A. In this embodiment, the support socket is a round tube with welded side supports connected through known techniques to the deck nose 42A. Optional internal bearings (not shown) within the support socket allow the post to rotate about a vertical axis within the support socket. A torsion spring (not shown) mounted within the post and vertical extent of the handle portion and to the support socket biases the aisle rail system 310 towards a closed position.

Above the support socket 316, the post 314 is fitted with an upper through-pin 330, and below the support socket, the post is fitted with a discontinuous lower locking collar 335. The lower extent of the support socket is provided with a slot 338 aligned with a discontinuity in the lower locking collar when the aisle rail system is in the open position. The support socket is engaged between the upper through-pin and the locking collar such that the post is not vertically translatable, unlike the previous embodiments.

At a lower extent of the post 314 is mated a proximal end of a short arm 318, whereby the short arm and the post are mutually rotatable about the vertical axis of rotation of the post. In addition, the proximal end of the arm is joined to the lower extent of the post via a pivot 336 such that the short arm is capable of pivoting in an arc about the pivot. An optional spring internal to the support socket (not shown) biases the short arm down and away from the post. The short arm in this embodiment is provided as a vertically oriented planar member. At a distal end of the short arm, a transverse axle 322 is disposed substantially parallel to the plane of the deck 40A from which the aisle rail assembly 310 is suspended. On either side of the short arm, first and second wheels 320A, 320B are mounted for rotation about the transverse axle.

Figure 4A:
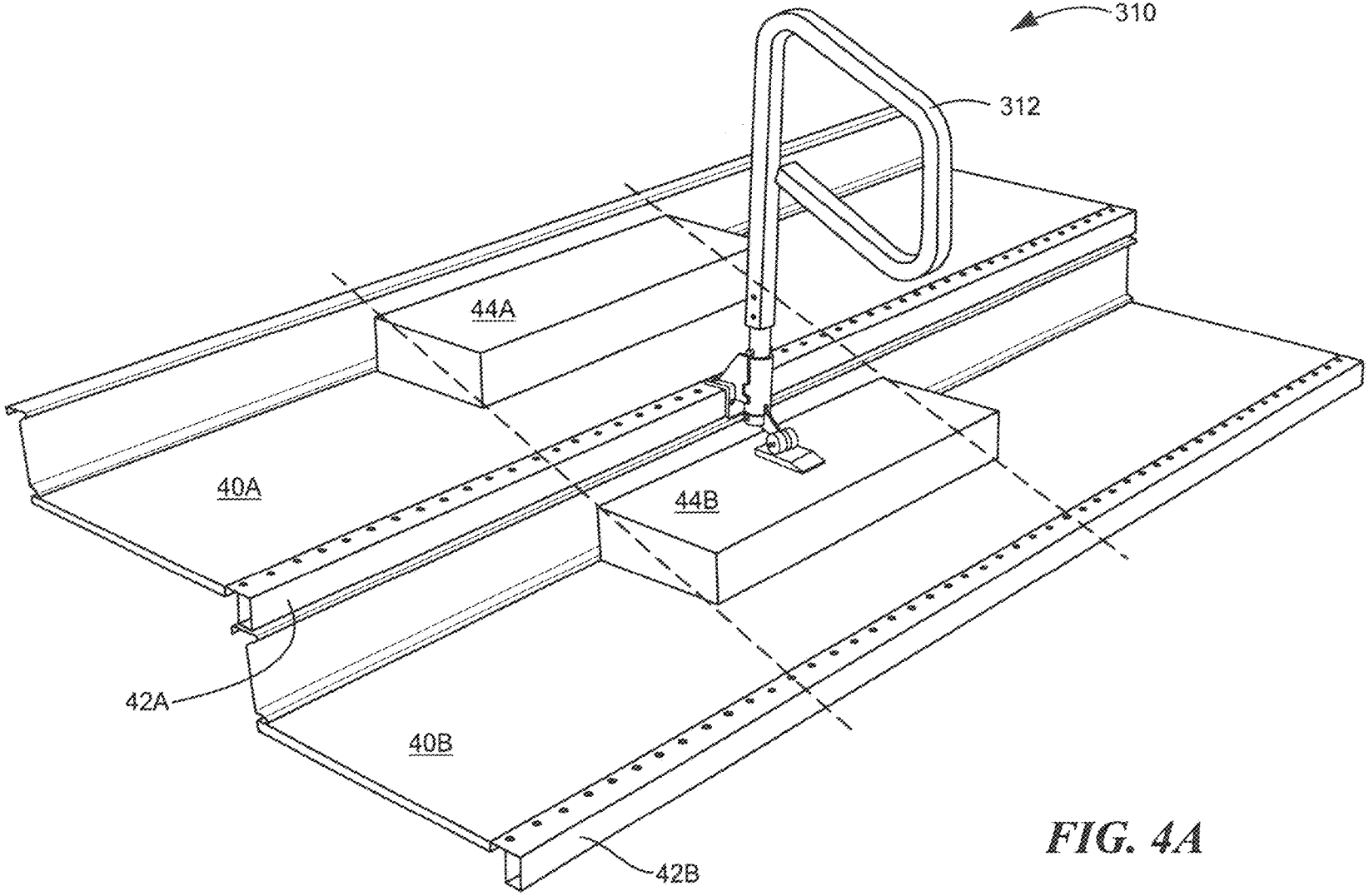
FIG. 4A is a perspective view of a fourth embodiment of an auto-rotating aisle rail system according to the present invention in a first, open position.
Figure 4B:
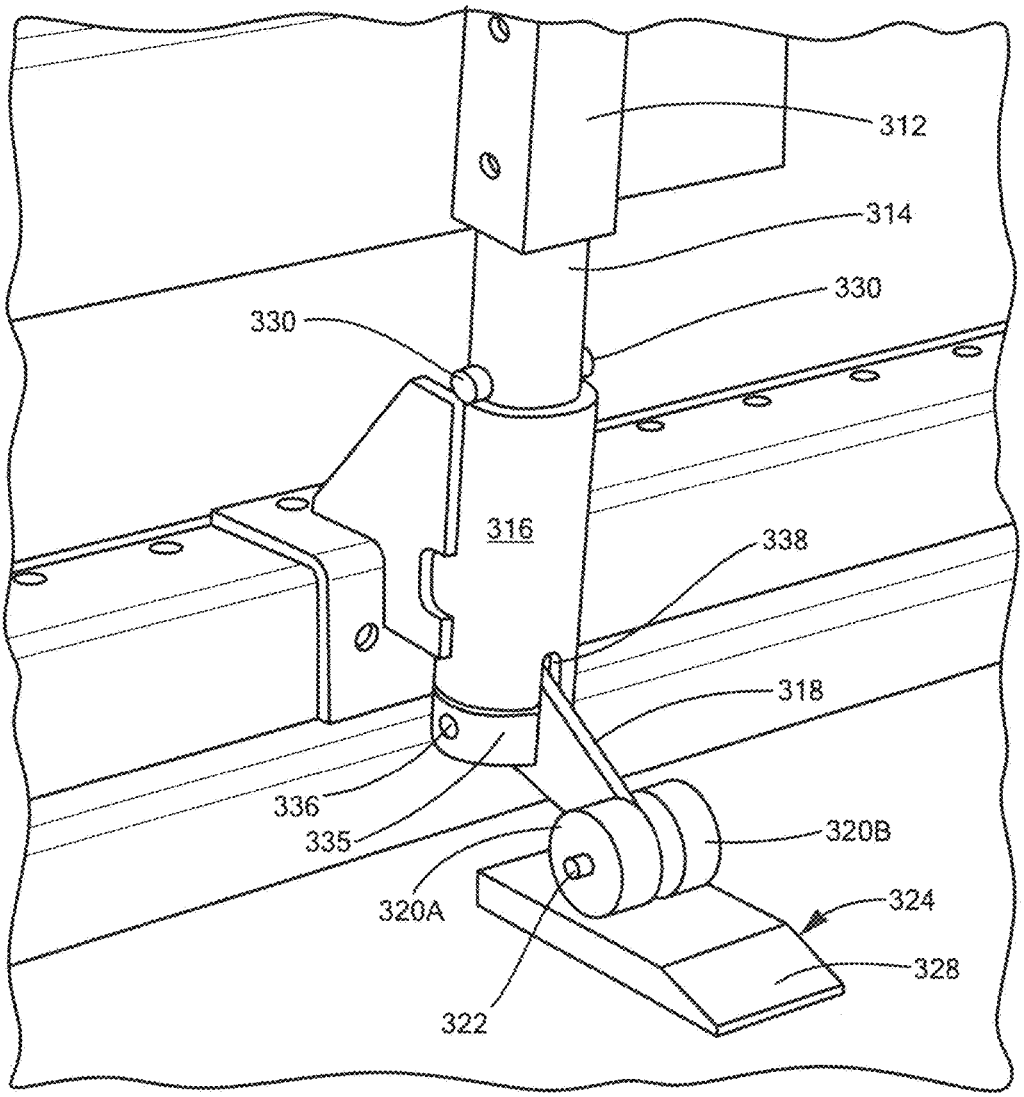
FIG. 4B is a detailed view of a portion of the auto-rotating aisle rail system fourth embodiment of FIG. 4A.
Figure 4C:
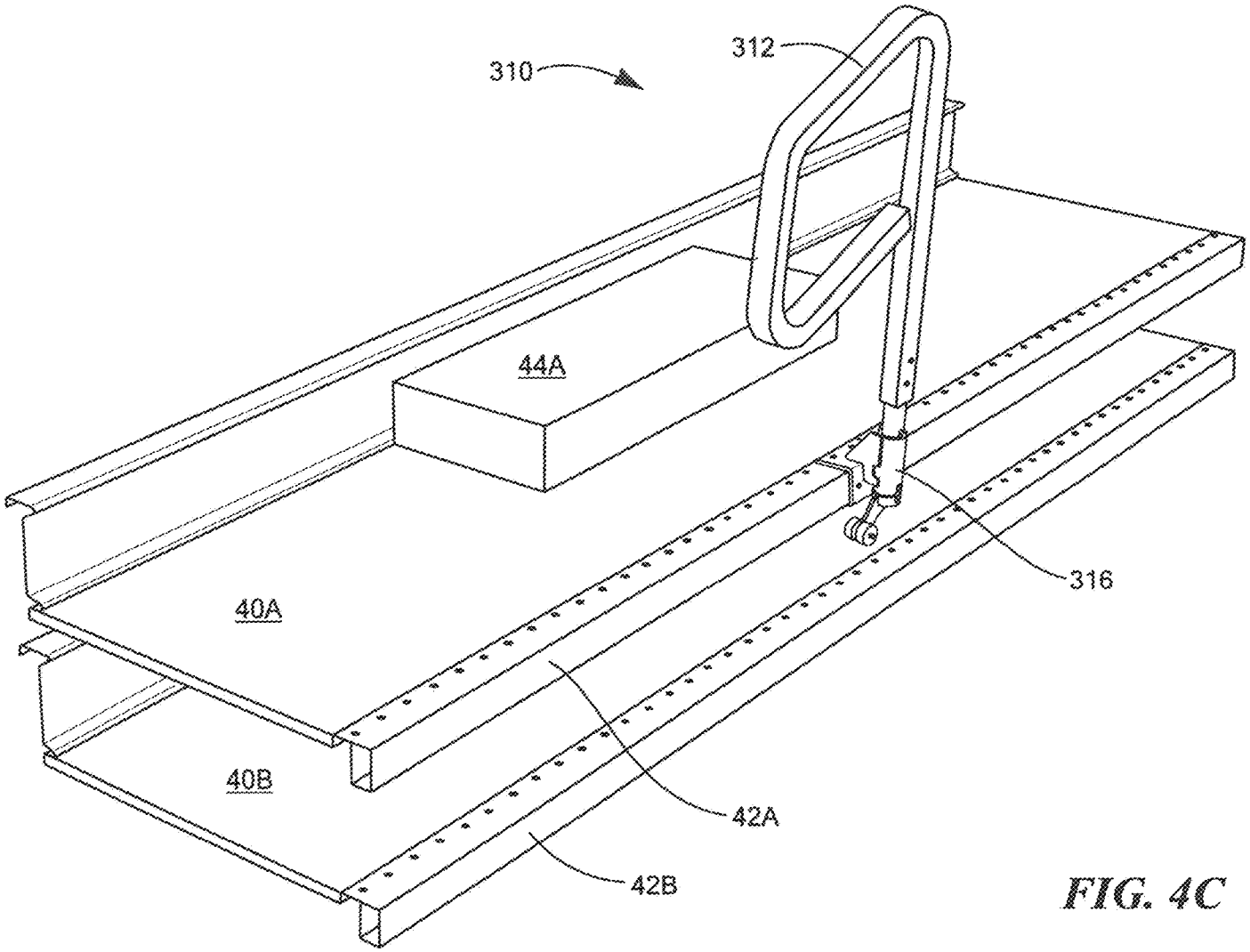
FIG. 4C is a perspective view of the auto-rotating aisle rail system fourth embodiment of FIG. 4A in a second, closed position.
Figure 4D:
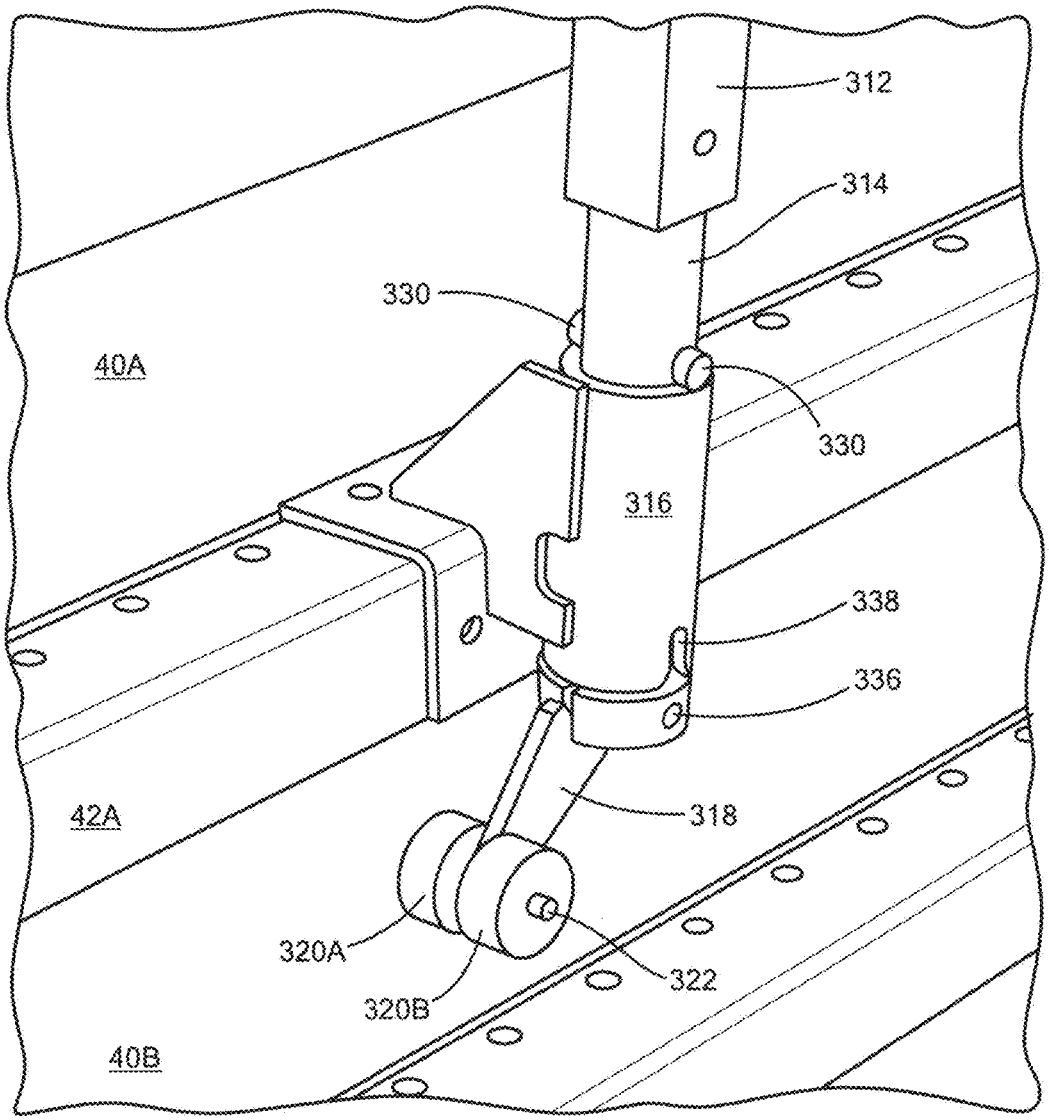
FIG. 4D is a detailed view of a portion of the auto-rotating aisle rail system fourth embodiment of FIG. 4C.

In a fashion similar to that of the previous embodiments, in an open position, the wheels 320A, 320B are disposed on top of a ramp 324 mounted to the top of an underlying step 44B. In this position, the short arm 318 is inclined upwards about the pivot 336, through the discontinuity in the lower locking collar, and is received within the slot 338, thereby rotationally locking the aisle rail assembly in the open position. As the bleacher system begins moving towards a closed position, the wheels begin rolling across the ramp and down an inclined portion 328 thereof, whereby the short arm moves in a downward arc, away from the post, out of engagement with the slot, thus rotationally freeing the post. With further relative movement of the deck 40A and lower step 44B, the wheels proceed across the step upper surface, then off that surface. The optional internal spring biases the aisle rail system 310 into the closed position, as shown in FIGS. 4C and 4D. Optionally, the upper extent of the support socket 316 may be provided with mechanical features such as upwardly extending tabs, similar to the mechanical stop 32 in FIG. 1B, that prevent the upper through-pin 330 from over-rotating past the closed position.

When the bleacher system is opened, the lower step 44B eventually comes into contact with the side edge of a proximate one of the short arm wheels 320A, 320B, thus urging the post 314 and handle 312 to rotate about a vertical axis. If the optional internal spring is employed, this urging is sufficient to overcome the spring bias towards the closed position. As the wheels are drawn up, on top of the lower step, the short arm 318 pivots upwardly about the pivot point 336 towards the post 314. Eventually, the wheels are drawn across the inclined portion 328 of the ramp 324. This raises the short arm upwardly again and into the slot 338, thereby rotationally locking the aisle rail system into the open position.

The rollers and wheels depicted above may be substituted among the various embodiments. In other words, the plural wheels 320A, 320B of FIGS. 4A through 4D may be substituted for the single roller 20, 120, 220 of any of FIGS. 1A through 3D. Likewise, the short arms 18, 118, 218, 318 may be substituted among the various embodiments as needed or desired. However, the shoart arm 318 and slot 338 in the embodiment of FIGS. 4A through 4D must be dimensioned with respect to each other.

While the embodiment of FIGS. 1A through 1D employs a support socket 16 in the form of a rectilinear box and the embodiments of FIGS. 2A through 2D and 4A through 4D employ a support socket 116, 316 in the form of a rounded tube with welded side supports, these are interchangeable as long as the various features specific to those embodiments are maintained.

While the first and fourth embodiments utilize through-pins to limit vertical movement and the second and third embodiments utilize locking collars for this purpose, the embodiments of each may be substituted as desired or as necessary.

In all of the embodiments, the height of the short arms in the closed position is adjustable in order to facilitate the operation of the aisle rail systems, as described.

The invention claimed is:

1. A rotatable aisle rail system for use with a telescopic and retractable bleacher disposed on a bleacher support surface, the bleacher having upper and lower deck portions with upper and lower deck surfaces, respectively, the upper deck surface disposed rearward of the lower deck surface when the lower deck portion is extended relative to the upper deck portion, the upper deck surface disposed at a first height above the bleacher support surface, the first height being above a second height of the lower deck surface above the bleacher support surface, the upper and lower deck portions including seating structures disposed thereon in a longitudinal direction extending along a width of the bleacher, the upper and lower deck portions having gaps between at least one pair of seating structures on each of the upper and lower deck portions so as to define an access-aisle for ingress to and egress from the bleacher in a direction generally perpendicular to the longitudinal direction, the lower deck portion comprising a step within the access-aisle having a forward edge, the rotatable aisle rail system comprising:

a substantially two-dimensional handle portion;

a substantially vertical post having an upper end and a lower end, the vertical post supporting the handle portion at the upper end of the vertical post;

a post support disposed about a lower extent of the post and configured to enable rotation of the vertical post about a post vertical axis, the post support configured for attachment to the upper deck portion within the access-aisle;

a short arm having a proximal end and a distal end, the proximal end being affixed to the vertical post such that the short arm extends radially outward from the vertical post towards the distal end and rotates in conjunction with rotation of the vertical post;

whereby, when the post support is attached to the upper deck portion, upon extension of the lower deck portion relative to the upper deck portion, the short arm is responsive to the extension of the lower deck portion and engagement of the short arm by the forward edge of the step to provide rotation of the short arm and the vertical post affixed thereto about the post vertical axis from a closed position in which the handle portion is substantially parallel to the forward edge of the step to an open position in which the handle portion is substantially perpendicular to the forward edge of the step.

2. The rotatable aisle rail system of claim 1, wherein the handle portion is formed of hollow metal having a cross-sectional shape selected from the group consisting of regular polygonal, irregular polygonal, circular, and elliptical.

3. The rotatable aisle rail system of claim 1 wherein the handle portion has a discontinuous rhomboid shape.

4. The rotatable aisle rail system of claim 1, wherein the handle portion and the vertical post are provided as a unit.

5. The rotatable aisle rail system of claim 1, wherein the post support is of a shape selected from the group consisting of a substantially rectilinear box and a substantially cylindrical collar.

6. The rotatable aisle rail system of claim 1, wherein the vertical post comprises at least one upper pin extending outwardly therefrom proximate an upper extent of the support socket, and wherein the post support comprises at least one mechanical stop projecting upwardly from the upper extent thereof, the at least one mechanical stop for selectively interfering with rotational travel of the at least one upper pin about the post vertical axis.

7. The rotatable aisle rail system of claim 1, wherein the vertical post comprises an upper locking collar adjacent an upper extent of the post support configured to limit downward travel of the vertical post relative to the post support.

8. The rotatable aisle rail system of claim 1, wherein the vertical post comprises a cam projecting outwardly therefrom in a region within the post support, wherein the post support comprises a helical slot configured to receive the cam, the helical slot having a first end and a second end, wherein the first end is offset substantially ninety degrees about the post support from the second end, and wherein the first end of the helical slot is more proximate than the second end of the helical slot to the lower end of the vertical post, whereby the vertical post elevates and rotates to the open position as the cam travels from the first end of the helical slot to the second end of the helical slot and descends and rotates to the closed position as the cam travels from the second end of the helical slot to the first end of the helical slot.

9. The rotatable aisle rail system of claim 1, wherein the vertical post comprises an upper locking collar extending about the vertical post proximate an upper extent of the post support.

10. The rotatable aisle rail system of claim 1, wherein the vertical post comprises a discontinuous lower locking collar coaxial with the vertical post and proximate a lower portion of the post support, the discontinuous lower locking collar comprising a horizontal pivot substantially orthogonal to a discontinuity in the discontinuous lower locking collar, the discontinuity configured to restrain rotation of the short arm about the vertical post vertical axis, wherein the post support includes a vertical slot extending upwardly through a lower portion of the post support, whereby the short arm is capable of rotating about the horizontal pivot, through the discontinuity in the discontinuous lower locking collar in a plane having a vertical component, and whereby the short arm is capable of being selectively received within the vertical slot in the post support when the discontinuity in the discontinuous lower locking collar is vertically aligned with the vertical slot in the post support.

11. The rotatable aisle rail system of claim 10, further comprising a resilient member disposed between the discontinuous lower locking collar and the short arm for biasing the short arm downwards about the horizontal pivot.

12. The rotatable aisle rail system of claim 1, further comprising a return spring mechanically connected between the post support and the vertical post and configured to bias the vertical post towards the closed position.

13. The rotatable aisle rail system of claim 1, wherein the post support comprises internal bearings for enabling free axial rotation of the vertical post therein.

14. The rotatable aisle rail system of claim 1 wherein the step comprises an intermediate step having a forward edge and an intermediate step surface having an intermediate step surface height above the bleacher support surface that is above the second height and below the first height, and wherein, upon extension of the lower deck portion relative to the upper deck portion, the short arm is configured such that the forward edge of the intermediate step engages the short arm to provide rotation of the short arm and the vertical post from the closed position to the open position.

15. The rotatable aisle rail system of claim 1, wherein the short arm includes a lower bearing surface and the step includes an abutment surface and upon extension of the lower deck portion relative to the upper deck portion, the lower bearing surface of the short arm engages the abutment surface of the step so as to urge the short arm and the vertical post vertically upward to produce locking engagement of a first locking structure of the vertical post with a cooperative second locking structure of the support socket to maintain the handle portion in the open position.

16. The rotatable aisle rail system of claim 15, wherein the vertical post comprises at least one lower pin extending outwardly therefrom proximate a lower portion of the support socket, wherein the post support comprises at least one notch in the lower portion thereof, the at least one notch configured to selectively receive the at least one lower pin when vertically aligned therewith, and wherein the at least one lower pin and the at least one notch comprise the first and second locking structures.

17. The rotatable aisle rail system of claim 15, wherein the short arm includes a transverse axle at the distal end thereof, wherein the distal end of the short arm includes a rolling member, the rolling member comprising at least one wheel disposed for rotation about the transverse axle, and wherein the rolling member includes the lower bearing surface.

18. The rotatable aisle rail system of claim 17, wherein the distal end of the short arm comprises a yoke with the transverse axle disposed thereacross.

19. The rotatable aisle rail system of claim 15, wherein upon retraction of the lower deck portion relative to the upper deck portion, the lower bearing surface of the short arm disengages from the abutment surface causing downward movement of the short arm and the vertical post so as to disengage the vertical post from rotational locking engagement with the post support to permit rotation of the vertical post within the post support from the open position to the closed position.

20. The rotatable aisle rail system of claim 1, wherein the short arm further includes a rolling member rotatably retained at the distal end thereof for rotation about a generally horizontal axis perpendicular to a longitudinal axis of the short arm; and the step includes a ramp having an inclined forward face wherein, when the lower deck portion is extended relative to the upper deck portion, the rolling member engages the ramp and the rolling member moves vertically upward on the inclined forward face of the ramp to produce upward vertical movement of the vertical post and engagement of a first locking structure of the vertical post with a second locking structure of the post support to secure the vertical post in the open position.

21. The rotatable aisle rail system of claim 1 further including the upper and lower deck portions and the seating structures.

22. The rotatable aisle rail system of claim 1, wherein the short arm includes a side portion and is configured such that the forward edge of the step engages the side portion of the short arm to provide rotation of the short arm and the vertical post in response to extension of the lower deck portion with respect to the upper deck portion.

23. The rotatable aisle rail system of claim 1, wherein the distal end of the short arm includes a rolling member having a side portion, and wherein the short arm is configured such that the forward edge of the step engages the side portion of the rolling member to provide rotation of the short arm and the vertical post.

24. The rotatable aisle rail system of claim 1, wherein the post support comprises a support socket having internal bearings configured to permit axial rotation of the vertical post about the post vertical axis.

* * * * *